US009518460B2

(12) United States Patent
Sørensen et al.

(10) Patent No.: US 9,518,460 B2
(45) Date of Patent: Dec. 13, 2016

(54) DOWNHOLE GAUGE ASSEMBLY

(75) Inventors: Per Hassel Sørensen, Sandnes, NC (US); Terje Baustad, Stavanger (NO)

(73) Assignee: Roxar Flow Measurement AS, Stavanger (NO)

( * ) Notice: Subject to any disclaimer, the term of this patent is extended or adjusted under 35 U.S.C. 154(b) by 300 days.

(21) Appl. No.: 14/235,297

(22) PCT Filed: Sep. 7, 2012

(86) PCT No.: PCT/EP2012/067479
§ 371 (c)(1),
(2), (4) Date: Jan. 27, 2014

(87) PCT Pub. No.: WO2013/037706
PCT Pub. Date: Mar. 21, 2013

(65) Prior Publication Data
US 2014/0130592 A1 May 15, 2014

(30) Foreign Application Priority Data
Sep. 15, 2011 (NO) ..... 20111255

(51) Int. Cl.
*E21B 49/08* (2006.01)
*E21B 47/06* (2012.01)
(Continued)

(52) U.S. Cl.
CPC ..... *E21B 47/06* (2013.01); *E21B 17/023* (2013.01); *H01R 13/58* (2013.01)

(58) Field of Classification Search
CPC ..... E21B 47/00; E21B 47/09; E21B 47/06; E21B 47/011; E21B 47/12
(Continued)

(56) References Cited

U.S. PATENT DOCUMENTS 3,079,182 A 2/1963 Appleton
3,939,705 A * 2/1976 Glotin ..... E21B 23/03 73/152.51
(Continued)

FOREIGN PATENT DOCUMENTS

DE 102005043158 A1 3/2007
DE 102008030373 A1 1/2009
(Continued)

OTHER PUBLICATIONS

Rampelmann, Klaus, prepared for PCT/EP2012/067479, as mailed Mar. 19, 2013, 7 pages.

*Primary Examiner* — Eric S McCall
*Assistant Examiner* — Mohammed E Keramet-Amircolai
(74) *Attorney, Agent, or Firm* — Nixon & Vanderhye P.C.

(57) ABSTRACT

Downhole gauge (1) assembly comprising a gauge housing (3) with a receiving aperture (32) having a sealing means (30) with an inner sealing surface (8). A gauge (4) is arranged in or in association to the gauge housing (3), a metal cable (7) with an inner bore is in communication with the interior of the housing (3). The cable runs from a downhole location to the top of a subsurface well. An electrical or optical conductor (9*a*, 9*b*) runs through the bore of the metal cable. The conductor (9*a*, 9*b*) is connected to the gauge (4) through a connector (5). The electrical or optical connector (5) is arranged within the gauge housing (3) and has been passed through said receiving aperture (32) of the gauge housing (3). The inner sealing surface (8) seals on the outer surface of the metal cable (7).

15 Claims, 5 Drawing Sheets

(51) Int. Cl.
*E21B 17/02* (2006.01)
*H01R 13/58* (2006.01)

(58) Field of Classification Search
USPC ..... 73/152.54, 37.9, 152.28
See application file for complete search history.

(56) References Cited

U.S. PATENT DOCUMENTS

| | | | | |
|---|---|---|---|---|
| 4,593,771 | A * | 6/1986 | Comeau | E21B 17/00 166/242.1 |
| 4,597,622 | A | 7/1986 | Coe | |
| 4,892,488 | A | 1/1990 | Nestor et al. | |
| 5,033,297 | A | 7/1991 | Gustafson | |
| 5,807,133 | A | 9/1998 | Arnett | |
| 5,833,490 | A | 11/1998 | Bouldin | |
| 6,305,944 | B1 | 10/2001 | Henry et al. | |
| 6,444,914 | B1 | 9/2002 | Su | |
| 6,523,609 | B1 * | 2/2003 | Miszewski | E21B 47/06 166/250.07 |
| 7,097,499 | B1 | 8/2006 | Purdy | |
| 7,988,481 | B2 | 8/2011 | Bethurum et al. | |
| 2005/0006102 | A1 * | 1/2005 | Cho | E21B 29/04 166/376 |
| 2005/0056415 | A1 * | 3/2005 | Zillinger | E21B 47/06 166/66 |
| 2008/0108241 | A1 | 5/2008 | Kocher et al. | |
| 2008/0217022 | A1 * | 9/2008 | Deans | E21B 47/12 166/338 |

FOREIGN PATENT DOCUMENTS

| | | | |
|---|---|---|---|
| EP | 0159466 | A2 | 10/1985 |
| GB | 1217739 | A | 12/1970 |
| GB | 2467177 | A | 7/2010 |
| WO | WO-2006090123 | A1 | 8/2006 |

* cited by examiner

DOWNHOLE GAUGE ASSEMBLY

The present invention relates to a downhole gauge assembly according to the introductory part of claim 1. In particular the invention relates to an assembly comprising a gauge housing connected to a metal cable with an inner bore that guides an electric and/or optic conductor(s) which communicates with a gauge.

BACKGROUND

In connection with subsurface wells, such as a hydrocarbon well, it is common to arrange gauges, such as pressure or temperature gauges, within the well bore. As it is difficult to provide wireless communication from a gauge in this position to a surface or seabed location, a hollow cable is guided down into the well bore, clamped to a pipe string. The cable guides one or more conductors, such as electrical or optical conductors, down to a gauge housing. Before lowering the gauge housing and the hollow cable with the conductor down into the well along with the pipe string, the crew connects the conductor to the gauge with an optical and/or electrical connector. In addition a pressure resistant barrier between the inside and outside of the cable and gauge housing is established. Thus, the connector is maintained in a low pressure environment with a barrier to the downhole high pressure environment.

When used in connection with a subsurface well, the downhole gauge assembly may be mounted topside on a floating surface installation associated with a subsea well or on a land based structure associated with an onshore well. In such instances the working conditions of the personnel on the installation can be affected by heave motions of the installation, as well as additional weather conditions. Any delay is costly as the rates of such surface installations are substantial. It is desirable to provide a gauge assembly which is easily and reliably assembled.

International patent application publication WO 2006090123 (Parker Hannifin PLC) describes a sealing connection between an annular sealing means and a tube. Such a sealing connection is well suited for downhole employment. Furthermore, there exists an apparatus for mounting the sealed connection, commercially available and marketed under the name of Phastite (trademark).

Patent application GB2467177 describes a sensing arrangement suitable for oil and gas wells, wherein a sensing fiber is conducted along a tubing into a well and adapted for sensing well conditions.

FIG. 1 shows a prior art solution for establishing a sealed connection between the hollow cable and a gauge housing, as well as an electrical or optical connection between a conductor and a connector. In this solution there exist two sealing sections. In addition, the crew needs to perform a delicate assembly of the numerous parts, sometimes in difficult conditions.

THE INVENTION

According to the present invention, there is provided a downhole gauge assembly comprising a gauge housing with a receiving aperture with an inner sealing surface. A gauge is arranged in or in association to the gauge housing. The assembly further comprises a metal cable with an inner bore which is in communication with the interior of the gauge housing, wherein the metal cable runs from a downhole location of a subsurface well up to the top of the subsurface well. An electrical or optical conductor runs through the bore of the metal cable and is connected to the gauge through an electrical or optical connector. The electrical and/or optical connector is arranged within the gauge housing and has been passed through the receiving aperture of the gauge housing. Furthermore, the inner sealing surface seals on the outer surface of the metal cable.

As will be appreciated by a person skilled in the art, the term "electrical or optical conductor" is meant to include a single conductor, being either an electrical conductor or an optical conductor, a plurality of electrical conductors or a plurality of optical conductors, or an appropriate number of both electrical and optical conductors. This will be chosen by the person skilled in the art as appropriate for the specific embodiment. The subsurface well may typically be a hydrocarbon well. It may also be an injection well, or any other type of subsurface well. Furthermore, the subsurface well may be a subsea well or a well located onshore.

Since the sealing surface of the receiving aperture can seal directly on the outer surface of the metal cable, the present invention exhibits an advantage compared with the prior art. In the prior art solution shown in FIG. 1 the receiving aperture seals to an intermediate element which further seals against the metal cable. Thus, such a solution requires sealing of two sets of two facing surfaces.

Various embodiments appear from the dependent claims.

EXAMPLE OF EMBODIMENT

Having described the main features of the present invention in general terms above, a more detailed non-limiting example of embodiment will be described below with reference to the drawings, in which FIG. 1 is a perspective view of a prior art downhole gauge assembly;

Figure 1:
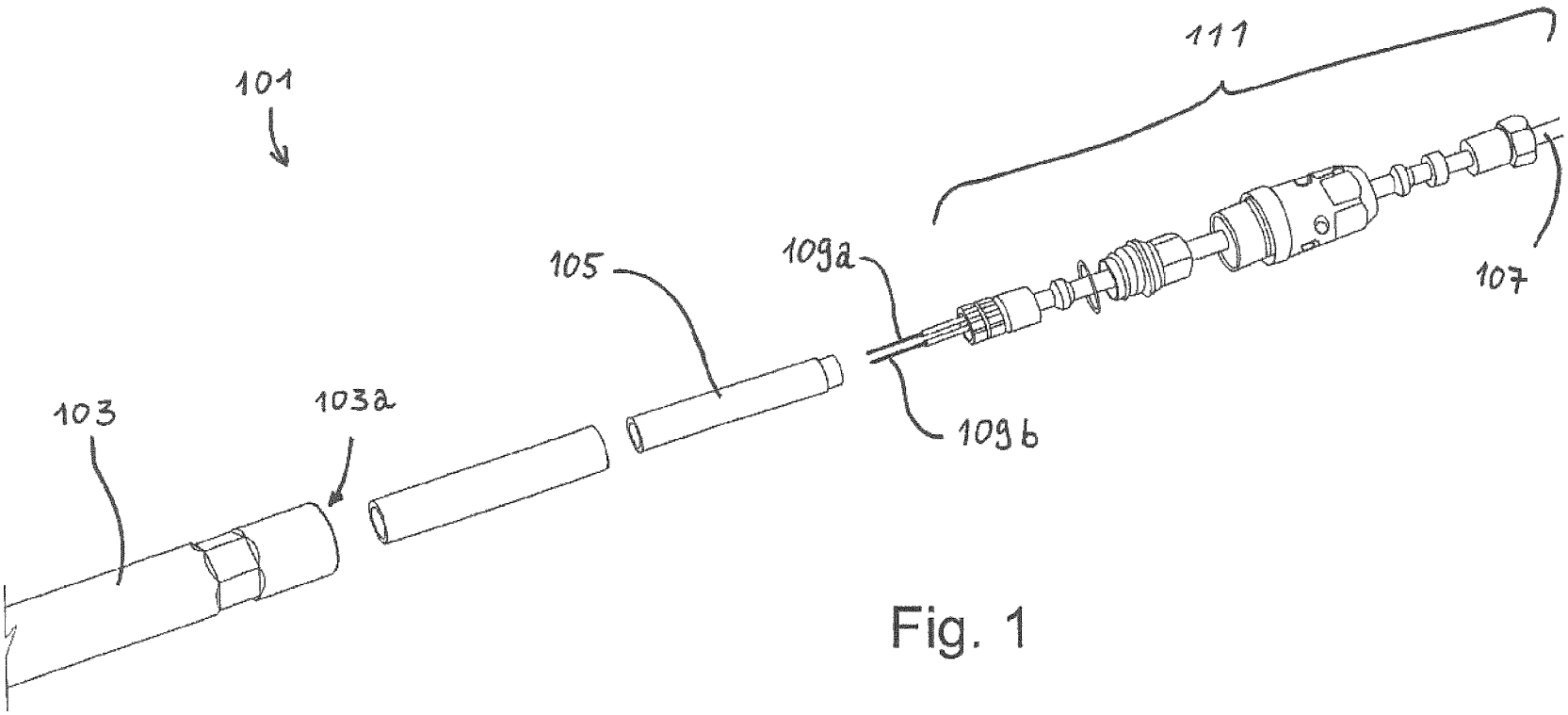
Fig. 1 Prior art

FIG. 1 shows a downhole gauge assembly 101 according to prior art. The assembly 101 comprises a gauge housing 103, an electrical connector 105, an end part of a hollow metal cable 107 and a first electrical conductor 109*a* and a second electrical conductor 109*b* running through the bore of the metal cable 107. When assembled, the two electrical conductors 109*a*, 109*b* will be connected to the electrical connector 105. The electrical connector 105 will be inserted into the gauge housing 103 and be connected to an electrical plug (not shown) arranged therein to provide electrical connection to a gauge (not shown) inside the housing 103.

In this prior art solution, the electrical connector 105 has an outer diameter which is larger than the diameter of the metal cable 107. Thus, in order to receive and accommodate the electrical connector 105, the gauge housing 103 must have a receiving opening 103*a* which is large enough for insertion of the electrical connector 105, and thus larger than the outer diameter of the metal cable 107. As a consequence of this, a sealing assembly 111 is arranged which seals between the gauge housing 103 and the sealing assembly 111, as well as between the sealing assembly 111 and the outer surface of the metal cable 107. In this prior art example, a plurality of parts are arranged onto the metal cable 103 in order to obtain these two seals.

Figure 2:
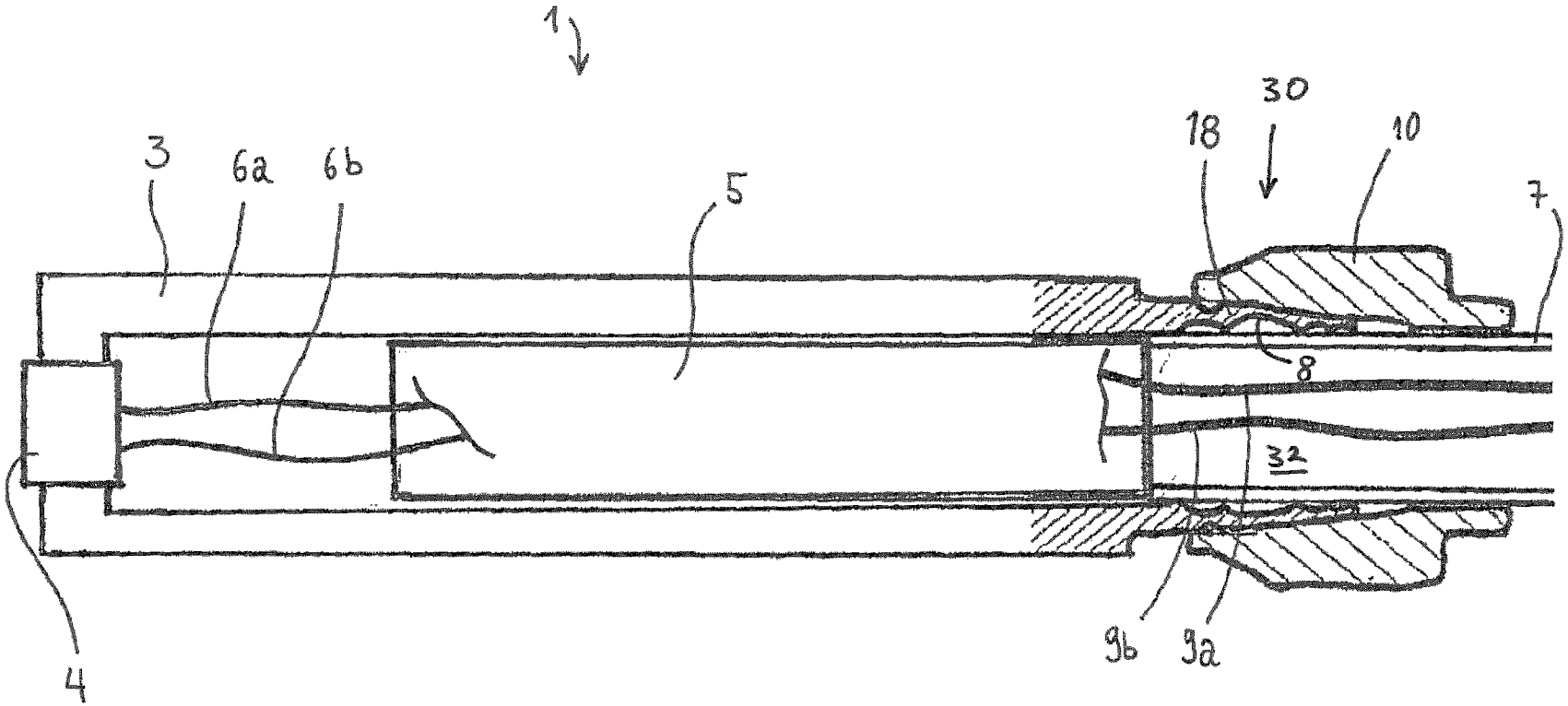
FIG. 2 is a cross section principle drawing of an embodiment of a gauge assembly according to the invention.

It is now referred to FIG. 2, which schematically illustrates an embodiment of a downhole gauge assembly 1 according to the present invention. The assembly 1 has a gauge housing 3 with a cylindrical shape and an inner bore. At one end of the gauge housing 3 there is arranged a temperature gauge 4. In this embodiment, the temperature gauge 4 is fixed to the gauge housing 3. In other embodiments, a gauge could be arranged within the gauge housing 3, or externally, having a wired or wireless connection to the gauge housing 3. As will be appreciated by the person skilled in the art, the gauge 4 could be any kind of suitable gauge, such as a pressure gauge.

Within the inner bore of the gauge housing 3 there is arranged an electrical connector 5, which will be described in more detail further below. Between the temperature gauge 4 and the electrical connector 5 there is established a first and second electrical connection, schematically indicated by the two wires 6*a* and 6*b*. However, as will be discussed further below, there is an electrical plug-connection between the gauge 4 and the electrical connector 5. On the opposite side of the electrical connector 5, a first electrical conductor 9*a* and a second electrical conductor 9*b* extend from the electrical connector 5 and into a metal cable 7. The end of the metal cable 7 abuts against the facing end of the electrical connector 5.

In this embodiment, the downhole gauge assembly is used in a subsea hydrocarbon well. The metal cable 7 can extend from a downhole location within the subsea well, up to the top of the subsea well, such as to a Xmas tree (not shown). A production tubing (not shown) extends into the well from the Xmas tree. The metal cable 7 is clamped to the outer surface of the production tubing. As will be appreciated by the person skilled in the art, the downhole gauge assembly according to the invention is also suitable for land-based subsurface wells.

The first and second electrical conductors 9*a*, 9*b* extend from the electrical connector 5 and up to the top of the well, through the bore of the metal cable 7.

At the end of the gauge housing 3 which is opposite of the gauge 4, the gauge housing 3 comprises a sealing means 30 with a receiving aperture 32 that receives the downhole end of the metal cable 7. The receiving aperture 32 has a sealing annular lip 18 which encircles the outer diameter of the metal cable 7. Furthermore, a collar 10 is arranged radially outside the annular lip 18 and the metal cable 7. The collar 10 and the annular lip 18 will be further described with reference to FIG. 3.

When establishing the downhole gauge assembly 1, the operator will insert the first and second conductors 9*a*, 9*b* (extending through the metal cable 7) into the electrical connector 5. Then he will insert the electrical connector into the gauge housing 3. I.e. he inserts the electrical connector 5 through the receiving aperture 32. Within the gauge housing 3 there is an electrical interface means, such as an electrical plug (not shown), which will establish an electrical connection between the electrical connector 5 and the temperature gauge 4. Along with the insertion of the electrical connector 5, he can insert the metal cable 7 into the receiving aperture 32 (annular lip 18) of the gauge housing 3 and make a sealing interface between the gauge housing 3 and the metal cable 7. The insertion of the metal cable 7 may be used to push the electrical connector 5 the correct distance into the gauge housing 3.

Figure 3:
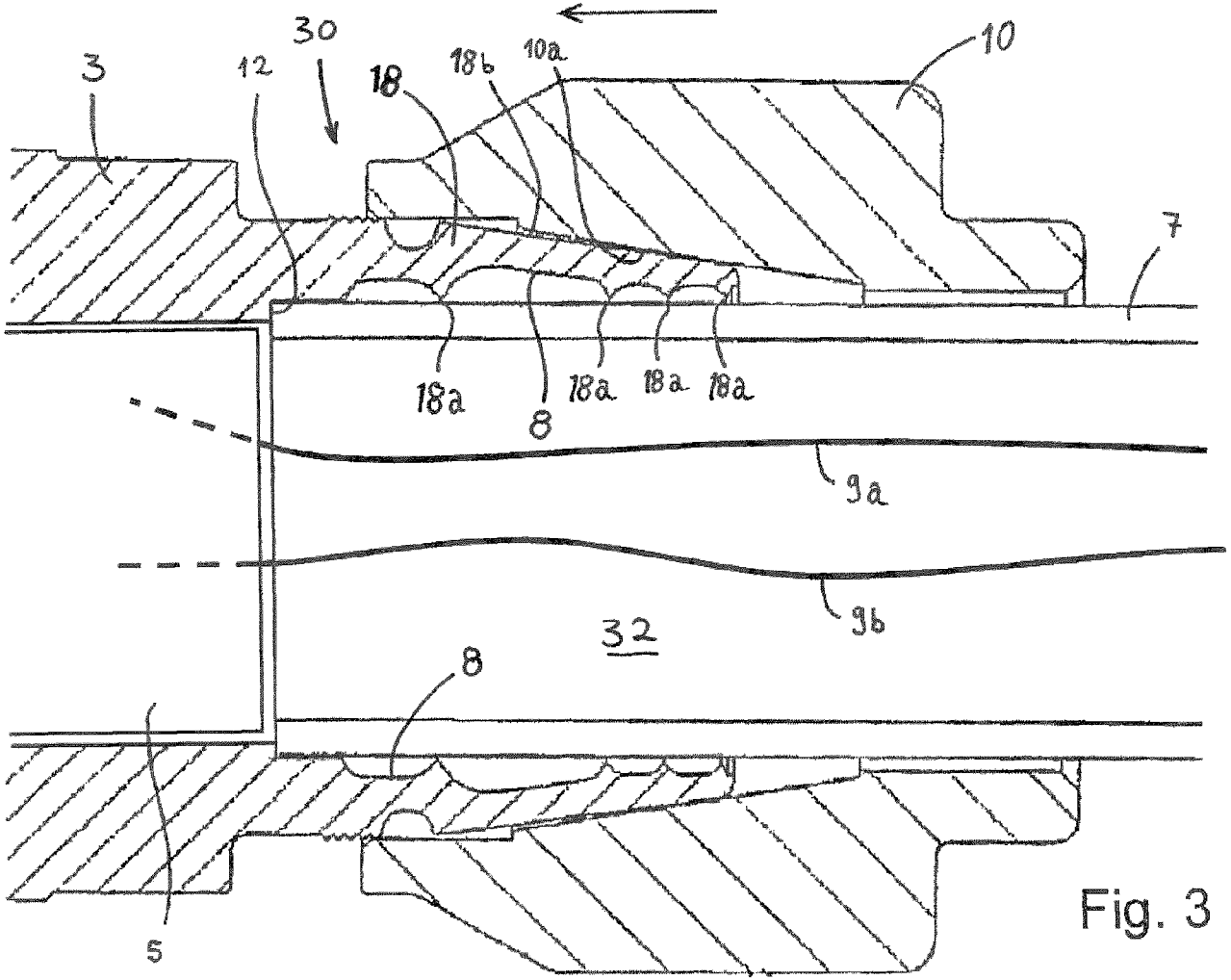
FIG. 3 is an enlarged cross section view of a sealing means according to the embodiment shown in FIG. 2.

FIG. 3 is an enlarged view of the interfaces between the metal cable 7, gauge housing 3, the sealing annular lip 18 and the collar 10. Since the temperature gauge 4 as well as the gauge housing 3 are adapted to be arranged at a downhole location, high temperature and pressure may be present in the environment of the gauge housing 3. In order to maintain a low pressure within the gauge housing 3 and in the bore of the metal cable 7, the interface between the metal cable 7 and the gauge housing 3 must be sealed.

This sealing means 30 is provided with the annular lip 18 which encircles the metal cable 7. The annular lip 18 comprises an inner sealing surface 8 with a plurality of annular protuberances 18*a* that extend radially inwards, towards and into the outer face of the metal cable 7. In this embodiment the sealing annular lip 18 comprises four annular protuberances 18*a*. In order to force the protuberances 18*a* into the outer face of the metal cable 7, a collar 10 is arranged outside the metal cable 7 and the sealing annular lip 18. The collar 10 exhibits an inclined actuation face 10*a* which is arranged to slide on an inclined and outwardly facing actuation face 18*b* of the annular lip 18. Thus, in order to force the protuberances 18*a* radially inwards, the collar 10 is moved in an axial direction towards the gauge housing 3 (direction of the arrow in FIG. 3). The two facing inclined (coned) faces 18*b*, 10*a* make the annular lip 18 being moved radially inwards, thereby forcing the protuberances 18*a* into the outer face of the metal cable 7. In this way, four metal-to-metal seals are created. The actuation of the collar 10 can preferably be performed by means of a tool (not shown).

Furthermore, the outwardly facing face of the annular lip 18 or an outwardly facing face of the gauge housing 3, over which a part of the collar 10 is moved, may preferably exhibit arresting protuberances, grooves or the like, that engages with an inwardly facing face of the collar 10. This is in order to prevent the collar 10 from moving backwards and out of engagement with the annular lip 18.

Still referring to FIG. 3, approximately at the base of the annular lip 18, the aperture of the gauge housing 3 is provided with an aperture shoulder 12. When inserting the metal cable 7 into the gauge housing 3 (the receiving aperture 32), the end of the metal cable 7 will abut against this aperture shoulder 12. One should also note, as can be appreciated from FIG. 3, that the outer diameter of the electrical connector 5 is larger than the inner diameter of the metal cable 7. The operator will then know that the metal cable 7 has been inserted a correct distance into the gauge housing 3, and that the metal cable 7 is in correct position of establishment of the sealing. Furthermore, due to the abutment against the aperture shoulder 12, the operator will not risk applying an excessive force onto the electrical connector 5. Such an excessive force could be detrimental to the electrical connector 5 as well as to the temperature gauge 4 at the opposite end of the gauge housing 3.

Figure 4:
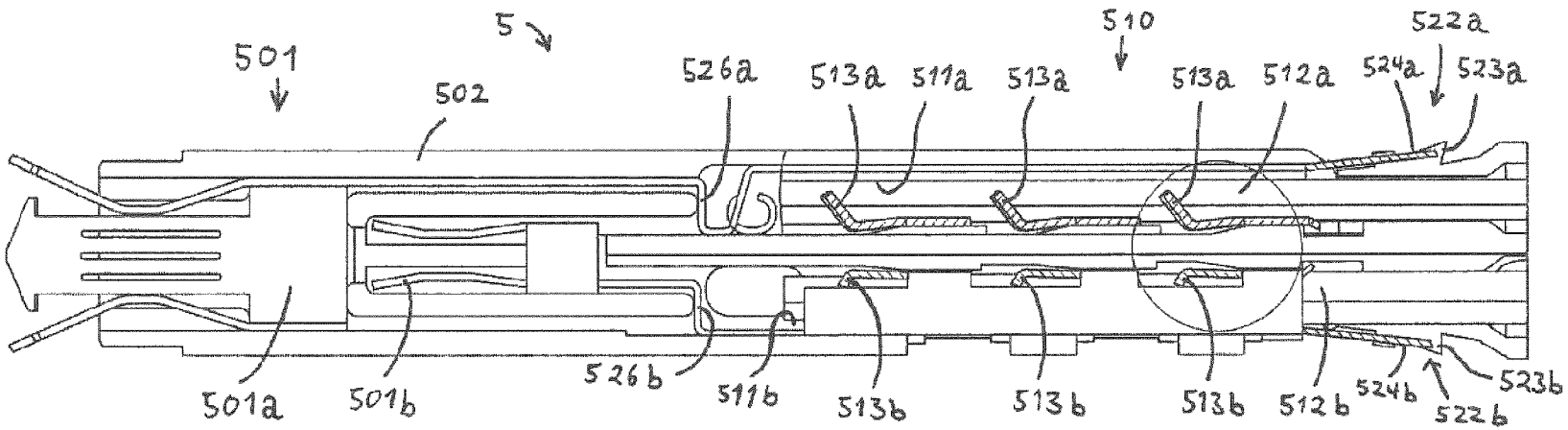
FIG. 4 is a cross section view of an electrical connector being part of the gauge assembly shown in FIG. 2, prior to inserting electrical conductors into the electrical connector.

FIG. 4 is a side view of the electrical connector 5, which is only schematically illustrated in FIG. 2 and FIG. 3. The electrical connector 5 has a main body 502 made of a non-conducting material, such as a hard plastic. At the left end of the electrical connector 5 shown in FIG. 4, it comprises a plug receiving means 501. The plug receiving means 501 comprises a first metal contact 501*a* and a second metal contact 501*b*. The first metal contact 501*a* is adapted to be mechanically biased towards the main stem of an electrical plug (not shown) inserted into the plug receiving means 501. The second metal contact 501*b* is adapted to be mechanically biased towards the end stem of the electrical plug. Thus, the interface between the plug (not shown) and the plug receiving means 501 provides a two-pole electrical communication between the temperature gauge 4 and the electrical connector 5. The plug will be fixed within the gauge housing 3 and will be inserted into the electrical connector 5 when the latter is pushed into the gauge housing 3.

To the right (in FIG. 4) of the plug receiving means 501 the connector 5 comprises a conductor receiving section 510 which is adapted to receive the first and second electrical conductors 9*a*, 9*b* (cf. FIG. 2 and FIG. 3). The conductor receiving section 510 has a first conductor retainer 512*a* and a second conductor retainer 512*b* adapted to receive and retain an electric conductor which is inserted into it. The first and second conductor retainers 512*a*, 512*b*, respectively, have a first guiding channel 511*a* and a second guiding channel 511*b*, into which the first and second electrical conductors 9*a*, 9*b* are inserted when the operator connects the electrical conductor 5 to the electrical conductors 9*a*, 9*b*. As mentioned above, the first and second electrical conductors 9*a*, 9*b* extend through the bore of the metal cable 7.

In the guiding channels 511*a*, 511*b* there are a plurality of inclined retainer protrusions 513*a*, 513*b*. When an electrical conductor, such as the end of a massive copper wire, is inserted into the guiding channel 511*a*, 511*b*, the inclined retainer protrusions 513*a*, 513*b* will extend partially in the direction of insertion and partially in the direction towards the electrical conductor.

In this embodiment, the first conductor retainer 512*a* as well as the first metal contact 501*a* (to the left in FIG. 4) are made of the same piece of metal. Correspondingly the second conductor retainer 512*b* and the second metal contact 501*b* are made of another piece of metal. Thus, in this embodiment the electrical connector 5 has only two metal components.

Due to the said direction of the retainer protrusions 513*a*, 513*b*, the operator will be able to insert the electrical conductor into the conductor retainers 512*a*, 512B, but will not be able to pull it back out. This is because, if pulling the conductor in the reverse direction, the respective retainer protrusions 513*a*, 513*b* will engage the conductor and stab into its surface.

In order to ensure and maintain this locking action once the electrical conductor has been inserted into a conductor retainer 512*a*, 512*b*, two particular features of the conductor retainers 512*a*, 512*b* are provided and will now be described. It is first referred to the enlarged view of FIG. 5. The retainer protrusion 513*a* shown in FIG. 5 comprises a protruding portion 514*a* and a flexing portion 516*a*. The flexing portion 516 extends from its attachment to the conductor retainer 512*a*, 512*b* in question, approximately in the direction of insertion of a conductor. Below (with respect to FIG. 5) or radially within the flexing portion is a void 518*a* into which the flexing portion 516*a* can move when an electrical conductor is inserted and thus pushes the retainer protrusions 513*a* away. If the user attempts to pull the conductor back out, after it has been inserted into the first conductor retainer 512*a*, the retainer protrusions 513*a* will engage the conductor, as discussed above. Furthermore, the interface between the conductor retainer 512*a* and the main body 502 of the electrical connector 5 is designed in such way that the conductor retainer 512*a* may be pulled a small distance in the reverse direction with respect to the main body 502, to a rear position (FIG. 6). (That is the direction opposite to the direction of insertion of the electrical connector). This will take place when pulling the electrical conductor. When pulled this distance, the flexing portion 516*a* of the retainer protrusion 513*a* will be moved into contact with an inclined face 520*a* of the main body 502 on the opposite side of the void 518*a*. When moved in a sliding manner against the inclined face 520*a*, the protruding portion 514 will be forced against the electrical conductor. Thus, when pulling the electrical conductor, its attachment to the conductor retainer 512*a* will be enhanced. As appears from FIG. 4 and FIG. 6, the three retainer protrusions 513*a* of the first conductor retainer 512*a* are all arranged in connection with such an inclined face 520*a*.

Figure 5:
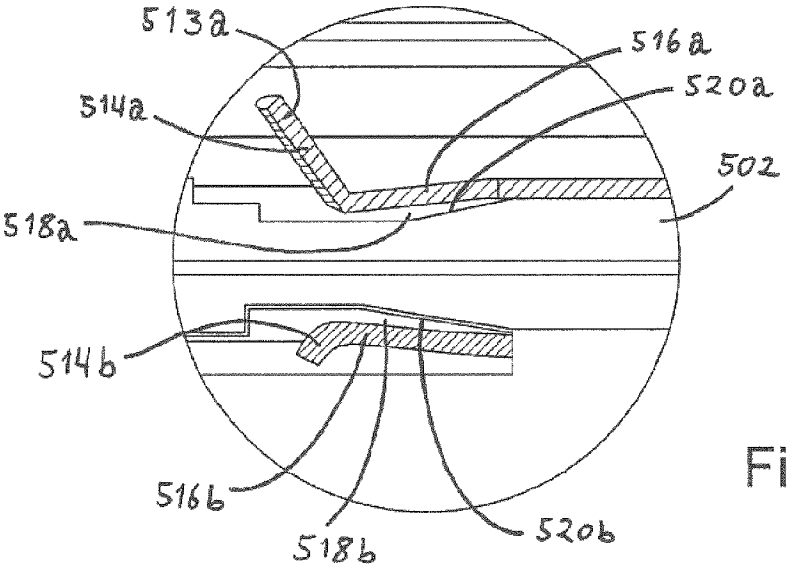
FIG. 5 is an enlarged view of a part of the electrical connector shown in FIG. 4.
Figure 6:
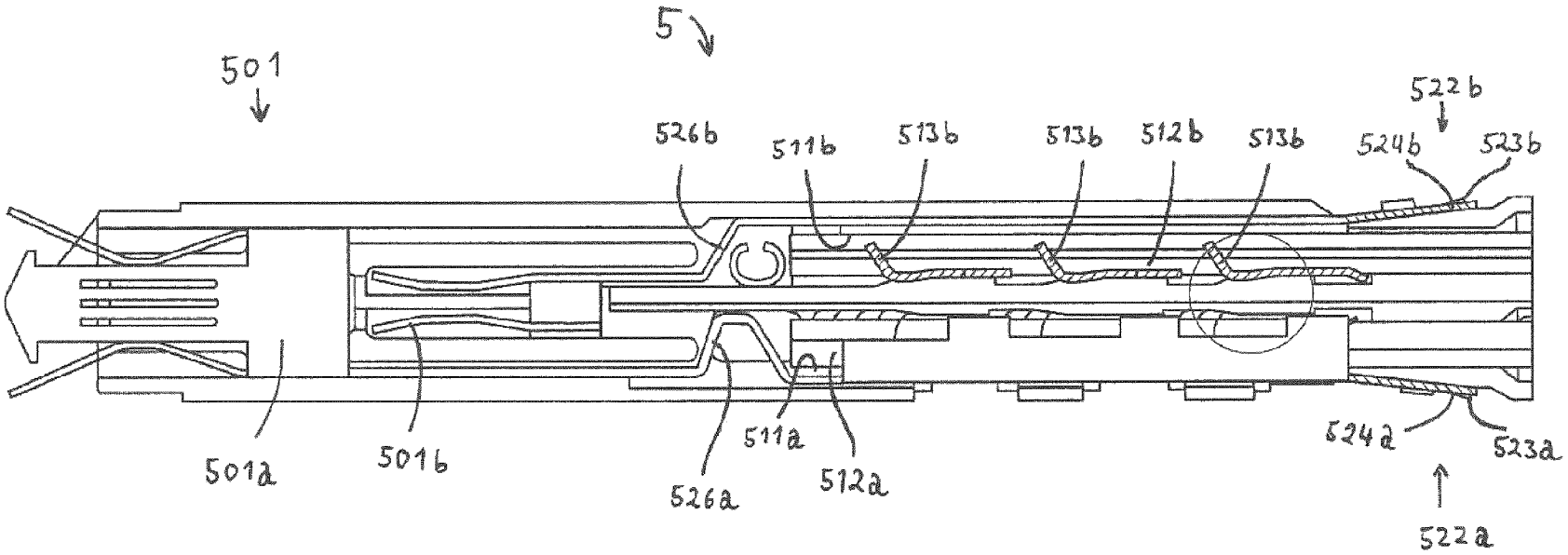
FIG. 6 is another cross section view of the electrical connector shown in FIG. 4, after inserting and securing electrical conductors within the electrical connector.

It should be noted that the cross section view of FIG. 6 is upside down with respect to FIG. 4 and FIG. 5. That is, the first conductor retainer 512*a* is shown below the second conductor retainer 512*b*.

Furthermore, when pulling the electrical connector in the reverse direction and thus moving the conductor retainer 512*a* in the reverse direction, the conductor retainer 512*a* will be locked into this pulled-back position. At a back portion of the conductor retainer 512*a*, in a radially outer position, the first conductor retainer 512*a* comprises a securing means 522*a*. The securing means 522*a* comprises a ratchet 523*a* and a ratchet aperture 524*a*. The ratchet 523*a* comprises an inclined face over which a part of the conductor retainer 512*a* slides when it is pulled in the reverse direction. Once pulled a sufficient distance, the ratchet 523*a* will enter into the ratchet aperture 524*a* of the conductor retainer 512*a* and in this manner lock the conductor retainer 512*a* in the back position.

In order to make possible the reverse pulling movement of the first conductor retainer 512*a* in the section comprising the first guiding channel 511*a*, with respect to the section comprising the first metal contact 501*a*, the first conductor retainer 512*a* comprises a bendable portion 526*a*. The bendable portion 526*a* is bended when the conductor retainer 512*a* is pulled in the reverse direction.

Correspondingly, the second conductor retainer 512*b* has a bendable portion 526*b*.

FIG. 4 shows the conductor retainer 512*a* in the front (original) position, whereas FIG. 6 shows the conductor retainer 512*a* pulled back into the rear position. From FIG. 6 one can appreciate how the bendable portion 526*a* is in a bent state compared to FIG. 4.

The described features of the first conductor retainer 512*a*, including the first guiding channel 511*a*, the first retainer protrusions 513*a*, and the securing means 522*a*, also exist correspondingly for the second conductor retainer 512*b*.

In another embodiment, the conductors could be optical conductors in stead of electrical. One can also imagine less or more than two conductors, or having both electrical and optical conductors. When using an optical conductor, the conductor receiving section of the connector could be shaped substantially as the conductor receiving section 510 of the electrical connector 5 in the above example.

The invention claimed is:

1. A downhole gauge assembly comprising:

a gauge housing including a receiving aperture defined by an inner sealing surface of the gauge housing, a gauge arranged in or in association to the gauge housing, a metal cable with an inner bore in communication with and extend into an interior of the gauge housing, wherein the metal cable extends from a downhole location of a subsurface well up to a top of the subsurface well, an electrical or optical conductor extending through the inner bore of the metal cable, wherein the electrical or optical conductor is connected to the gauge through an electrical or optical connector, wherein the electrical or optical connector is arranged within the gauge housing and is configured to, at least, extend to said receiving aperture of the gauge housing;

wherein the inner sealing surface of the gauge housing abuts and seals against an outer surface of the metal cable;

wherein the electrical or optical connector has an elongated cylindrical shape with a diameter in a range between an outer diameter of the metal cable and a diameter of the inner bore of the metal cable.

2. The downhole gauge assembly according to claim 1, comprising at least two electrical or optical conductors extending through the inner bore of the metal cable and connected to the gauge through the electrical or optical connector.

3. The downhole gauge assembly according to claim 1, wherein the electrical or optical connector comprises a conductor retainer configured to retain the electrical or optical conductor in an axially fixed position.

4. The downhole gauge assembly according to claim 1 wherein the electrical or optical conductor is axially movable within the inner bore of the metal cable.

5. The downhole gauge assembly according to claim 1, wherein the metal cable is clamped to a carrier pipe extending into the subsurface well.

6. The downhole gauge assembly according to claim 1, wherein:

the inner sealing surface of the receiving aperture includes an annular lip, and the annular lip comprises a plurality of annular protuberances that extend radially inwards towards and abuts the outer surface of the metal cable.

7. The downhole gauge assembly according to claim 6, wherein said annular lip includes an outer surface tapered radially inward, and the downhole gauge assembly further comprises an annular collar around the outer surface of the annular lip and biasing the annular lip against the outer surface of the metal cable.

8. The downhole gauge assembly according to claim 1, wherein the electrical or optical connector comprises:

at least one conductor retainer including a longitudinal extension of the conductor;

said conductor retainer including a guiding channel configured to receive the longitudinal extension of the conductor, and said guiding channel including a plurality of inclined retainer protrusions configured to be bent by insertion of an end portion of said conductor and to bias against a movement of said end portion out of the conductor retainer.

9. The downhole gauge assembly according to claim 8, wherein the inclined retainer protrusions extend in a direction having direction components aligned with and perpendicular to the insertion of the conductor end portion.

10. The downhole gauge assembly according to claim 8, wherein the retainer protrusions comprises a protruding portion protruding with an inclined face inclined with respect to the direction of insertion and towards an inserted conductor, and a flexing portion configured to flex into a void when a conductor is inserted into the conductor retainer.

11. The downhole gauge assembly according to claim 10, wherein the inclined face faces the flexing portion, at an opposite side of the void, and the flexing portion is configured to slide on the inclined face when the conductor is pulled in a reverse direction, thereby forcing the protruding portion against the conductor.

12. The downhole gauge assembly according to claim 11, wherein the conductor retainer further comprises a bendable portion which makes an axial movement of the retainer protrusions.

13. The downhole gauge assembly according to claim 8, wherein the conductor retainer comprises a ratchet and ratchet aperture configured to hold the guiding portion in a rear position if pulled to such a position by a pull in the conductor.

14. A downhole gauge assembly comprising:

a gauge housing including, at one end, an annular inner sealing surface defining a receiving aperture;

a gauge mounted in or to the gauge housing;

a metal cable having a distal end mounted to the gauge housing and extending into the receiving aperture, wherein an outer annular surface of the metal cable is adjacent and abuts the annular inner sealing surface of the gauge housing, and wherein the metal cable extends from a subsurface, downhole location in a subsurface well at least to a wellhead of the subsurface well;

a cylindrical connector within the gauge housing and having an end facing an end of the metal cable, wherein the end of the cylindrical connector has a diameter between an outer diameter of the end of the metal cable and a diameter of a bore of the metal cable at the end of the metal cable, and a conductor configured to provide communication from the gauge to a location at or beyond the wellhead, wherein the conductor extends through the cylindrical connector and the bore of the metal cable.

15. The downhole gauge assembly as in claim 14, wherein the cylindrical connector includes a conductor retainer configured to retain the conductor, wherein the conductor retainer includes a guiding channel configured to receive an end of the conductor, and an inclined retainer protrusions configured bend during insertion of the conductor into the conductor retainer and unbend upon full insertion of the conductor and thereby prevent removal of the conductor form the conductor retainer.

* * * * *